United States Patent [19]

Blontrock

[11] Patent Number: 4,844,130

[45] Date of Patent: Jul. 4, 1989

[54] WEAVING LOOM BLADE CROSSBEAM

[75] Inventor: Daniel Blontrock, Rumbeke, Belgium

[73] Assignee: N. V. Verbrugge, Belgium

[21] Appl. No.: 183,560

[22] Filed: Apr. 19, 1988

[30] Foreign Application Priority Data

Apr. 28, 1987 [EP] European Pat. Off. ..... 87870056.6

[51] Int. Cl.[4] ..... D03C 9/06

[52] U.S. Cl. ..... 139/92

[58] Field of Search ..... 139/91, 92

[56] References Cited

U.S. PATENT DOCUMENTS 4,307,757 12/1981 Shimizu ..... 139/91
4,484,604 11/1984 Kramer et al. ..... 139/92
4,503,890 3/1985 Kramer ..... 139/92
4,633,916 1/1987 Rast ..... 139/92

FOREIGN PATENT DOCUMENTS 2620778 10/1977 Fed. Rep. of Germany .
2312923 12/1976 France .
488035 5/1970 Switzerland ..... 139/91

*Primary Examiner*—Henry S. Jaudon
*Attorney, Agent, or Firm*—Laubscher, Presta & Laubscher

[57] ABSTRACT

Weaving loom blade crossbeam that comprises two edge areas separated one from the other by a median area, with one of the edge areas strengthened in the longitudinal direction of the crossbeam by a material that contains an armature of fibers, and with the other edge area carrying a warp catch bar and displaying, possibly, one slit, at least. When the median area forms one whole with the aforesaid other edge area and is therefore made, partially at least, of the same metal as part, at least, of this other edge area, this median area comprises a plate or metal frame, whereas, when the median area consists of a part separate from this other edge area and fitted to the latter by glueing or moulding, this median area is formed essentially by a material strengthened by fibres.

11 Claims, 5 Drawing Sheets

WEAVING LOOM BLADE CROSSBEAM

BACKGROUND OF THE INVENTION

This invention relates to a weaving loom blade crossbar that comprises in its longitudinal direction, two edge areas separated one from the other by a median area, with one of the edge areas strengthened in the longitudinal direction of the crossbeam by a material that contains an armature of fibers, and with the other edge area that consists essentially of metal, carrying a heddle member and displaying, possibly, at least one slit that extends at least partly opposite this member.

More specifically, the invention aims at proposing a weaving loom blade that is relatively light and yet very strong and rigid in order to be suitable for high speed weaving looms in which the blades are then subjected to very great to and fro accelerations.

Another objective of this invention is a weaving loom blade crossbar made to high constructional precision standards, in particular where the linearity of the heddle member is concerned.

SUMMARY OF THE INVENTION

For this purpose and according to the invention, when the median area is integral with the aforesaid other edge area and is therefore made, partially at least, of the same metal as at least part of this other edge area, this median area comprises a metal plate or frame whereas, when the median area consists of a part separate from this other edge area and fitted to the latter by glueing or molding, this median area is formed essentially of a material strengthened by fibers in such a manner that stresses in the median area that forms an angle of 45° with the longitudinal direction of the crossbeam can be absorbed.

According to a first form of embodiment of the invention, and when the median area consists essentially of a metal plate, this median area comprises at least one layer of a relatively light and noise-attenuating material that is fitted as a reinforcement to this plate, laterally against at least one of the large longitudinal surface areas of the latter and, when the median area consists essentially of a metal frame that displays edges between which openings are made, at least one of these openings, is sealed with a noise-attenuating material.

According to a different form of embodiment of the invention and when the median area consists essentially of a material strengthened by fibers, one connecting element that displays a cross section in the shape of a fork is provided between the aforesaid other area adjacent to this area of the median area, thus allowing for fitting these two areas together by glueing or molding and, possibly, by clamping.

BRIEF DESCRIPTION OF THE FIGURES

Other details and special features of the invention will be shown by the description below as non-restrictive examples of some special forms of embodiment of the invention with reference to the appended drawings.

FIG. 8 is a cross section view according to line VIII—VIII of FIG. 7 whereas

DETAILED DESCRIPTION

In these various figures, the same reference numbers are referring to analogous or indentical elements.

Generally speaking, the objective of the invention is to propose a very light yet rigid and strong weaving loom crossbeam made to high standards of precision, which is achieved through a combination and judicious selection of different and specific materials.

More specifically and according to the invention, by using materials displaying very specific properties in well-defined places of the crossbeam, it has been possible to obtain an extremely light weaving loom blade that displays a rigidity far superior to that of existing blades.

It has been found that this result can be achieved in different manners that will be illustrated in a more concrete manner via the various examples of crossbeams described below and shown in the appended drawings.

Figure 2:
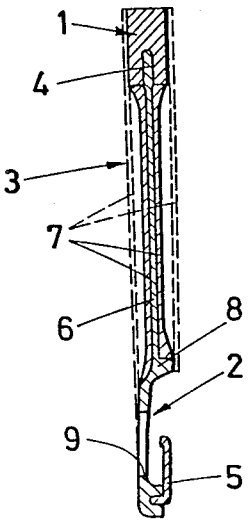
FIG. 2 is a sectional view according to line II—II of FIG. 1.
Figure 1:
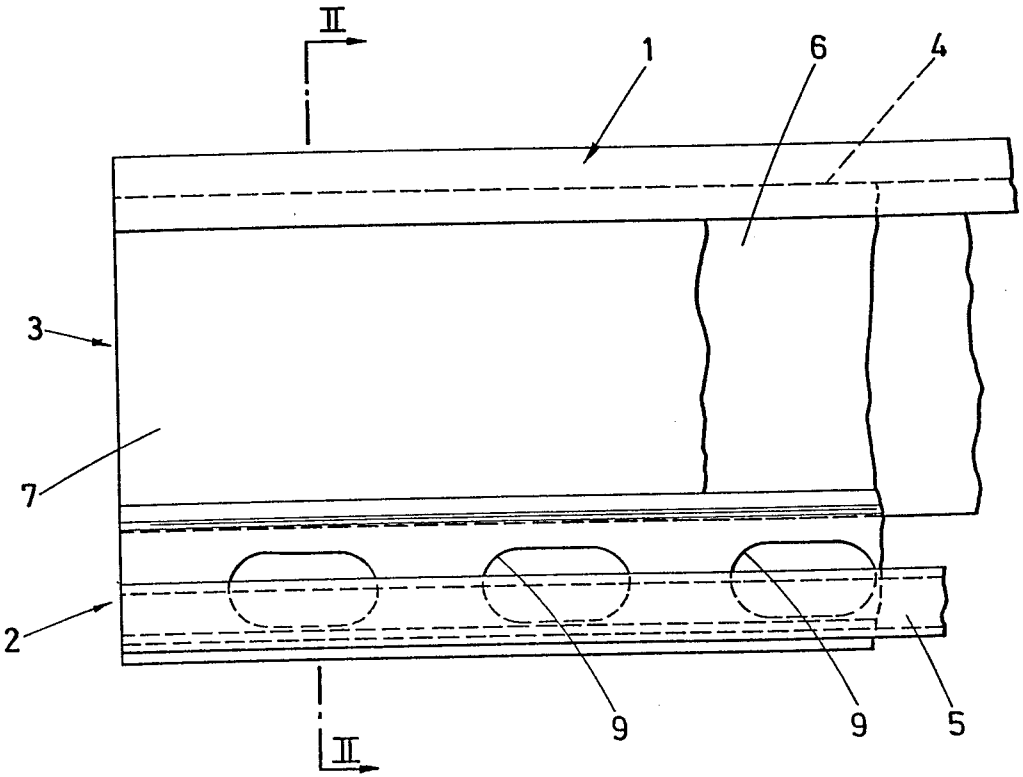
FIG. 1 is a plan view with partial fragments of a first form of embodiment of a weaving loom blade crossbeam according to the invention.

FIG. 1 and 2 concern a first form of embodiment of a crossbeam that meets the requirements of lightness, rigidity and precision according to the invention.

This crossbeam comprises in its longitudinal direction, two edge areas 1 and 2 that are separated one from the other by median area 3.

One of the edge areas 1 consists of a U-profile obtained via pultrusion of carbon fibers impregnated with epoxy resin, for instance, the wings of which extend on both sides of the edge 4 adjacent to the median area 3 and are glued to the latter.

The other edge area 2 is made of aluminium and carries a heddle member 5.

This member extends in parallel with the longitudinal axis of the crossbeam and can be screwed, riveted and/or glued to one of the faces of this edge area 2.

According to this form of embodiment, the median area 3 comprises a continuous plate 6 made of aluminium integral with the edge area 2.

Furthermore, a layer 7 made of a relatively light and noise-attenuating material is glued or molded, as a reinforcement to this plate 6, to each of the large longitudinal faces of the latter.

This layer 7 may consist of synthetic plastic material such as polyester, epoxy resin or polyurethane strengthened with glass, carbon or other fibers oriented in such a manner that the stresses created in the median area 3 that forms an angle of 45° with the longitudinal direction of the crossbeam can be absorbed by these fibres.

As a variant, it is possible to consider advantageously the glueing, between this reinforced plastic material layer 7 and plate 6, of a foam material layer made, for instance, of polyurethane, polyether of latex and the function of which is therefore essentially the attenuation of noise. This foam material could thus fill the hollows on both sides of the plate 6 between the projecting U-shaped profile that is forming the edge area 1, on one hand, and the edge area 2 separated, in particular, by a rib 8 from the median area 3, on the other hand. In such a case, the fiber-strengthened material could also extend outside up against the profile of the edge area 1 and, partly, onto the edge area 2 as shown schematically in broken lines in FIG. 2.

Finally, a series of slits 9 are made, preferably, in the edge area 2, partially opposite the heddle member 5 for the warps, in order to allow for the removal of dust between this bar and the edge area 2 and for the purpose of replacing the warps more easily.

In yet another variant and if the requirements regarding rigidity and noise-attenuation are less stringent, for instance, the layers 7 made of fiber-strengthened plastic material with underneath, possibly, foam material layers, could simply be omitted.

Figure 4:
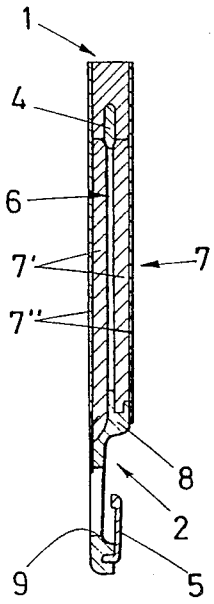
FIG. 4 is a sectional view according to line IV—IV of FIG. 3.
Figure 3:
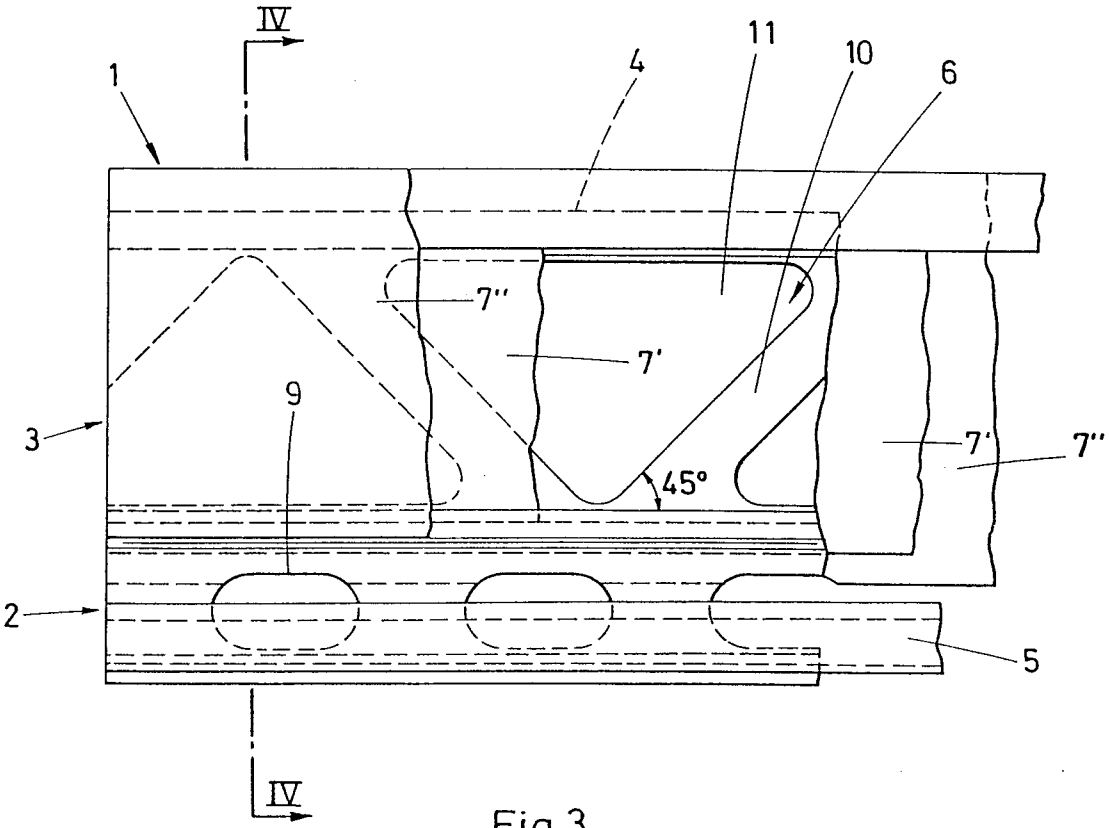
FIG. 3 is a plan view with partial fragments of a second form of embodiment of such a crossbeam.

The form of embodiment of the crossbeam according to the invention as shown in FIG. 3 and 4 differs essentially as compared to that of the FIGS. 1 and 2 in that the median area 3 is formed by an aluminium frame, more specifically by a perforated plate, in such a manner as to display edges 10 between which openings 11 are made. These edges extend according to an angle of 45° in relation to the longitudinal axis of the crossbeam while delimiting thus the openings that display the shape of rectangular triangles.

In this special form of embodiment, these openings 11 are sealed by means of a noise-attenuating material 7 that allows, furthermore, for increasing the rigidity of the crossbeam and for preventing the buckling of the edges 10. This material consists of two superposed layers that extend on both sides of the frame 6 and that are glued one to the other and to this frame.

This material 7 consists, more specifically, of a rigid foam material layer 7' made, for instance, of polyurethane and glued to the two outer faces of the frame 6, in the hollows formed between the projecting sections of the areas 1 and 2, and of a plastic material layer 7'' made, for instance, of epoxy resin or polyester strengthened with glass, carbon or similar fibers, and glued simply to the lateral faces of the profile 1, of the foam material layer 7' and of part of the edge area 2.

Figure 6:
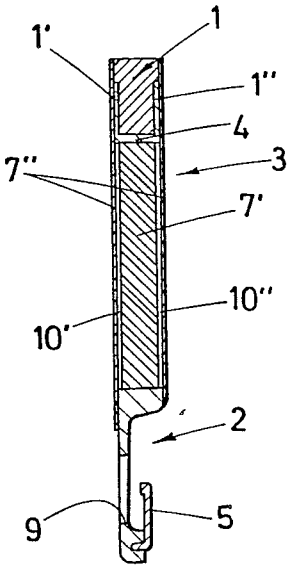
FIG. 6 is a sectional view according to line VI—VI of FIG. 5.
Figure 5:
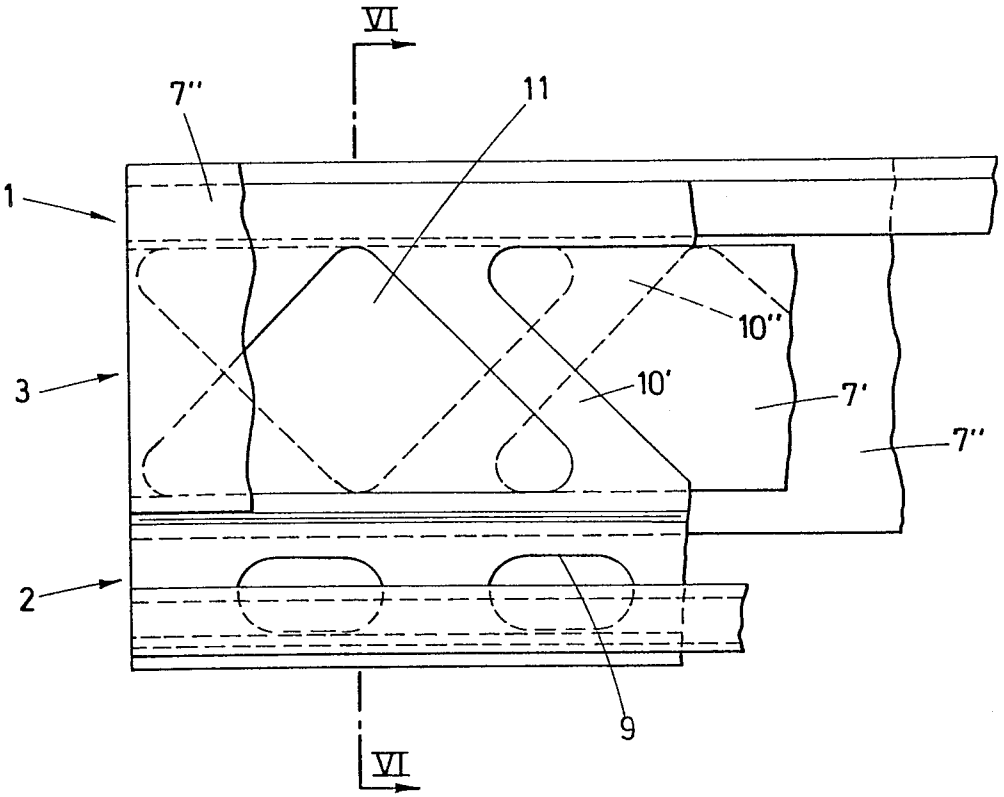
FIG. 5 is a plan view with partial fragments of a third form of embodiment of such a crossbeam.

The FIGS. 5 and 6 concern a form of embodiment of the crossbeam according to the invention that differs essentially from that shown in the FIGS. 3 and 4 in that the frame consists of a perforated tubular profile of rectangular section.

The median area 3 thus comprises edges 10' and 10'' that are arranged in parallel planes that extend at a certain distance one form the other. The space left between these two series of edges 10' and 10'' is filled with foam material, for instance of rigid polyurethane which allows, on one hand, for improving noise-attenuation and, on the other hand, for providing the crossbeam with a certain additional rigidity. Furthermore, a layer of synthetic plastic material strengthened by glass, carbon or similar fibers is fitted by glueing to the outer faces of this double frame 6 and extends, preferably, also onto the lateral face of the area 1 and onto part of the area 2. Contrary as compared to the previous two forms of embodiment, the area 1 is formed by a prismatic rod strengthened by carbon fibers, obtained through pultrusion, which is secured by glueing between the wings 1' and 1'' provided at the longitudinal edge 4 of the median area 3, opposed to the edge that displays the edge area 2 and situated in the planes of the edges 10' and 10''.

Figure 8:
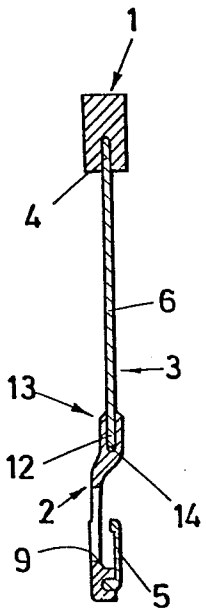
Figure 7:
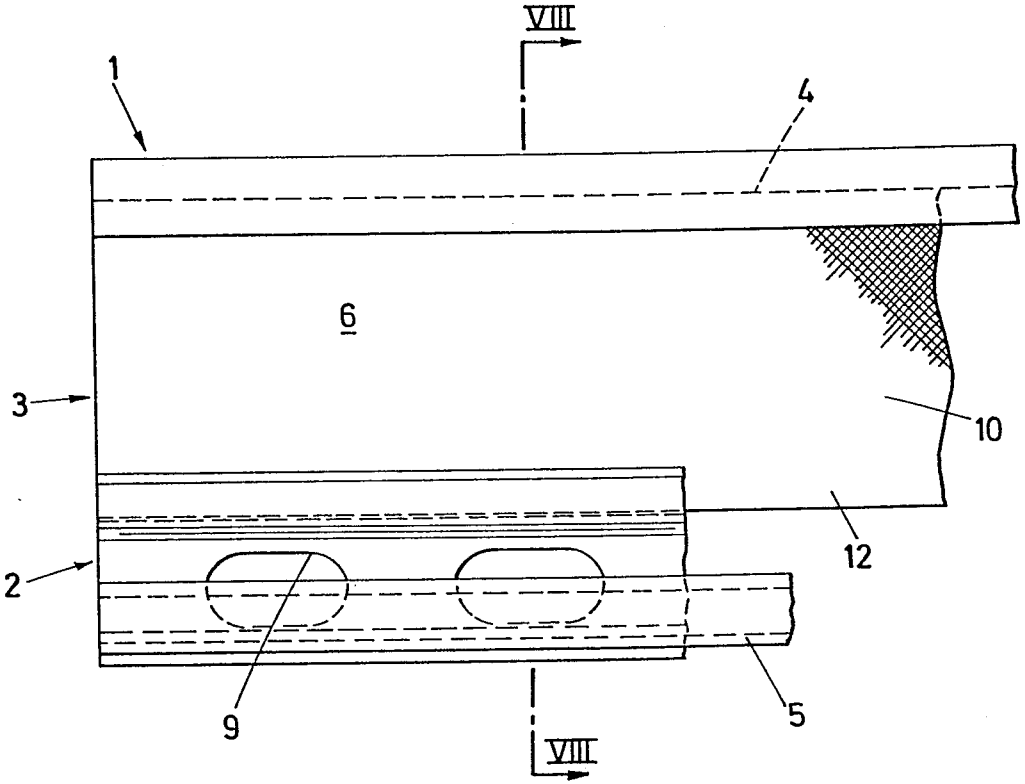
FIG. 7 is a plan view with partial fragments of a fourth form of embodiment of such a crossbeam according to the invention.

The crossbeam according to invention shown in the FIGS. 7 and 8 differs essentially from all the previous forms of embodiment in that the median area 3 does not comprise any aluminium part but that it is made entirely of synthetic plastic material strengthened by glass, carbon or similar fibers, in a thickness of 2 mm at the most.

An essential part, at least, of these fibers extend at an angle of 45° as compared to the longitudinal axis of the crossbeam and the fibers are practically continuous over the full height of this median area so as to allow for absorbing the lateral stresses that may develop in this median area when assembled in a weaving loom blade. Part of these fibers 10 are shown schematically in FIG. 7.

These fibers may be glass, carbon or similar fibers and they may be arranged in, at least, three layers placed one next to the other in such a manner that an essential part of the fibers of the middle layer form an angle of 90° with an essential part of the fibers of the adjacent layers. Each of these layers may comprise continuous fibers impregnated with resin and obtained through pultrusion. In other cases, each of the layers may consist of a fabric made of crossed carbon, glass or similar fibers.

Another significant difference as compared to the previous forms of embodiment and that results directly from the fact that the median area 3 is made entirely of a hard synthetic plastic material strengthened by practically continuous glass, carbon or similar fibers, is that the edge area 2 that is always made of metal, in particular of aluminium, according to the invention, is glued by its longitudinal edge 12 adjacent to this area 2.

In this respect, the latter displays advantageously, a connecting element 13 with a section in the shape of a fork, so as to form in this manner a slit into which is then engaged and glued this edge 12 adjacent to the median area 3.

A certain clearance 14 may be left between the bottom of the slit delimited by the fork 13 and the aforesaid edge 12 of the median area 3, in order to compensate in this manner, for a possible sag of the median area 3 when this edge is being glued in the fork.

As a matter of fact and because this median area 3 is made of plastic material, a certain deformation of this area may occur during the hardening process of this material and the result would be that the edge 12 is no longer perfectly straight.

On the other hand, the fact that the area 2 is made of aluminium does not give rise to any problem where keeping the bar 5 perfectly straight is concerned, in spite of the fact that, initially, the edge 12 may not be entirely straight.

As in the forms of embodiment according to FIGS. 1 to 4 the edge area 1 may also be formed by a profile obtained through pultrusion and that contains carbon fibers impregnated with resin and that extend according to the longitudinal direction of this profile.

Figure 9:
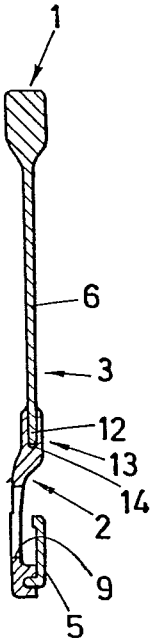
FIG. 9 is an analogous sectional view of a fifth form of embodiment.

FIG. 9 shows a slight variant of the form of embodiment of FIGS. 7 and 8 in that the area 1 is integrally formed with the median area 3 and is therefore obtained simultaneously with this area 3.

Figure 11:
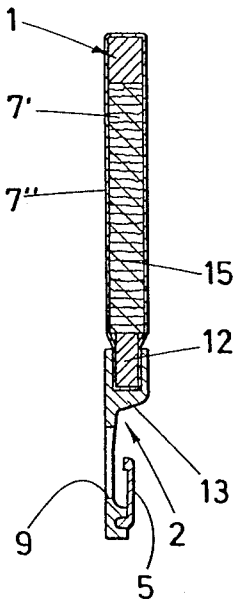
FIG. 11 is a sectional view according to line XI—XI of FIG. 10.
Figure 10:
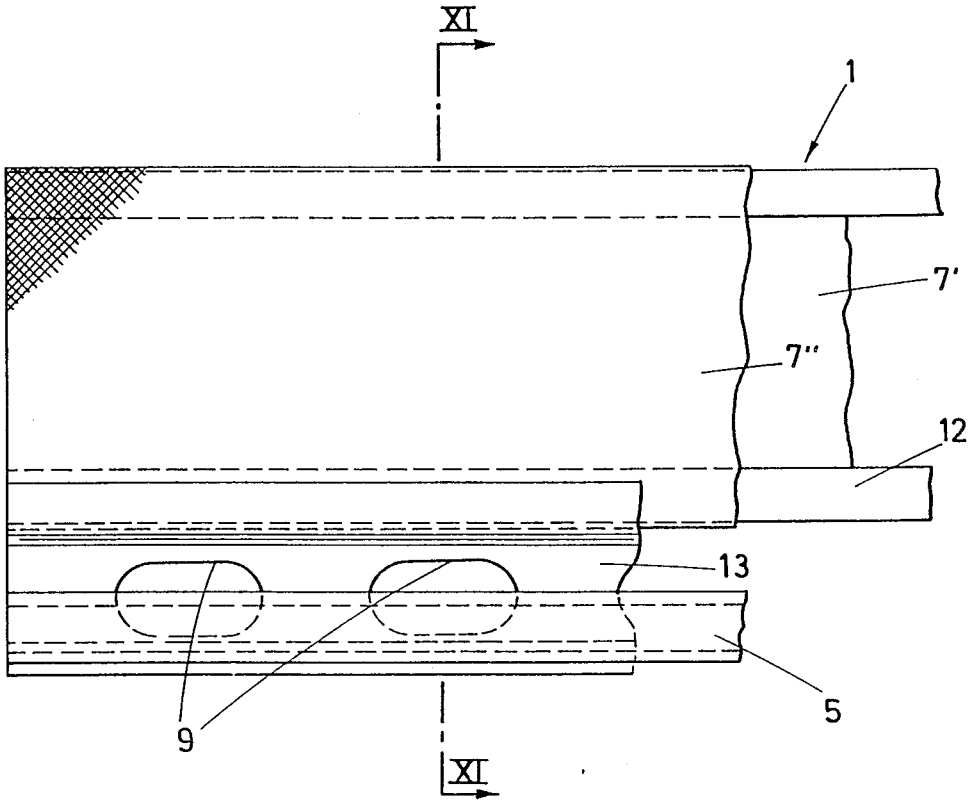
FIG. 10 is a plan view with partial fragments of a sixth form of embodiment of a crossbeam according to the invention.

In the crossbeam according to the form of embodiment shown in FIGS. 10 and 11, the median area 3 comprises, on one hand, a tridimensional fabric that displays actually two networks made of threads arranged in two parallel planes and interconnected via strands 15 that are practically perpendicular to these two networks distributed practically evenly in the space that separates the latter and, on the other hand, a foam material made, for instance, of hard polyurethane or epoxy that fills the space between the networks and also envelops the latter, in such a manner as to delimit this space by a layer of this foam material in which the networks constitute an armature.

Thus, a median area 3 is obtained of which the lateral walls 7'' are formed by a layer of synthetic plastic material strengthened by woven fibers, which allows to absorb the transverse stresses that may occur in this area, and the core 7' of which consists, on one hand, of strands 15 that interconnect the lateral walls 7'' and, on the other hand, of a hard foam material that provides this area with the rigidity required.

The edge area 1 consists essentially of a rod made via pultrusion of carbon fibers sunk into an appropriate resin.

A similar rod extends on the side opposite to the median area 3 and forms the edge 12 of the latter that is glued into the connecting element 13 of the edge area 2 in the same manner as in the form of embodiment shown in FIGS. 8 and 9.

The fixation of these two rods to the body of the median area 3 is achieved advantageously by slipping them first into the lateral edges of a strip of the aforesaid tridimensional fabric, between the two networks of these edges, and then by placing the entire unit into a mold into which a reactive mix of synthetic plastic material is injected, between the two networks of the fabric, in such a manner as to separate these networks and to stretch the latter along the inner walls of the mold during the foaming of the reactive mix, while enveloping at the same time the two rods with the aforesaid foam material.

Figure 13:
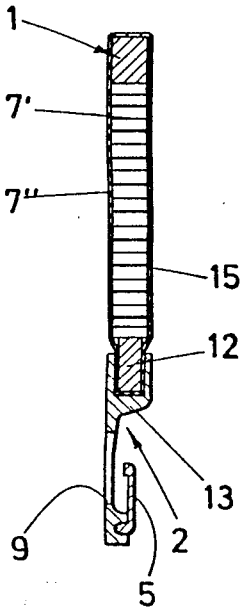
FIG. 13 is a sectional view according to line XIII—XIII.
Figure 12:
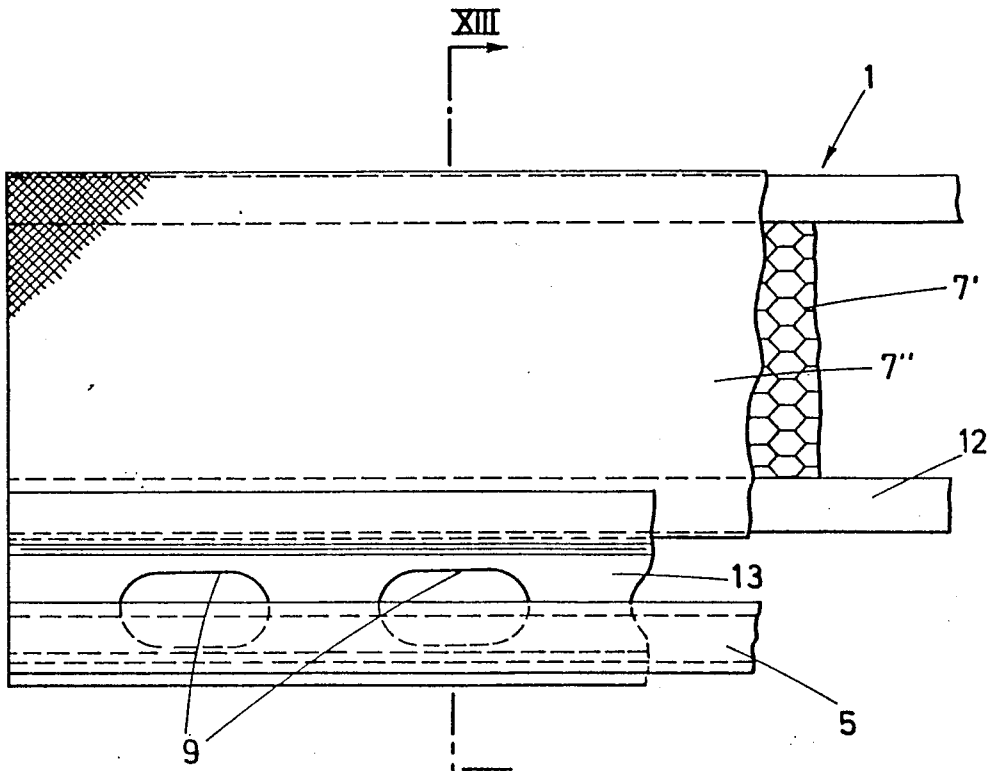
FIG. 12 is a plan view with partial fragments of a seventh form of embodiment of a crossbeam according to the invention.

Finally, in yet another form of embodiment of the crossbeam according to the invention, shown in FIGS. 12 and 13 that is somewhat similar, where the outer aspect is concerned, at least, to the form of embodiment according to FIGS. 10 and 11, the median area 3 comprises a core that displays a honeycomb pattern structure made of very thin aluminium, the two longitudinal faces of which are covered with layers of synthetic plastic material strengthened by carbon, glass or similar fibers as, for instance, in the two forms of embodiment shown in FIGS. 3 to 6. The fixation of these synthetic plastic material layers with the honeycomb core can be achieved by effecting the hardening of this material on the core itself in an appropriate mold.

As in the form of embodiment shown in FIGS. 10 and 11, the edge area 1 opposite to that carrying the heddle member, may consist of a rod made of carbon fibers sunk into a resin, whereas a practically similar rod can be provided for at the edge of the median area fitted to the area that is carrying the aforesaid bar. These two rods can be fitted in this manner to the honeycomb core in the aforesaid mold by enveloping them, in the same manner as this core, with the reinforced plastic material.

In the various forms of embodiment of the crossbeam according to the invention as described above and shown in the appended figures, the plastic material strengthened by fibers features advantageously a very high module of elasticity and a low specific gravity. This module of elasticity is advantageously equal to or higher than 180,000 $N/mm^2$ and preferably about 190,000 $N/mm^2$. In this respect and particularly where the edge areas 1 are concerned, preference has been given to an armature made of "U.D.-high modulus - 190,000 $N/mm^2$" type carbon fibers, the specific gravity of which is about 1.6 to 1.7.

The explanation above shows that the basic objective of the invention is to restrict to a minimum the metal part of the crossbeams for weaving loom blades and to use as much as possible, light synthetic plastic materials strengthened by fibers with a high module of elasticity. Considering, however, that it is not advisable to drill holes in such a reinforced plastic material, it has been envisaged, according to the invention, to use a metal edge area, preferably made of aluminium, to which is then fitted the warp catch bar.

The design of the crossbeam according to the invention has allowed for obtaining weaving loom blade crossbeams that are lighter by 30 to 35% as compared to known conventional crossbeams, and for obtaining an increase of 60%, at least, in crossbeam rigidity.

It is well understood that the invention is not restricted to the various forms of embodiment described above and shown in the appended figures, but that many variants may be envisaged without exceeding the limits of this invention, in particular as regards the nature of the plastic material and of the fibers used and also where the assembling of the various component parts of the crossbeam is concerned.

Thus, in certain cases, the connecting element 13 may be part of the median area instead of the area 2.

Furthermore, in some cases, the median area made of reinforced plastic material could be fitted to the edge area 2 made of metal, by molding this plastic material directly onto the edge area 2. The latter could be made partly only of metal, in yet another variant, in particular in the place with the slits 9, or it could be made of a thin metal plate that would be sunk into resin and that would be, possibly, molded or glued directly onto the median area 3.

Finally, in yet another variant, the edge area 1 and the median area 3 part adjacent to this area 1 could be curved in the shape of a vault, in particular when the median area 3 consists of a metal plate that is perforated or not, as in the forms of embodiment in the FIGS. 1 to 4, so as to provide better resistance against the sagging forces.

I claim:

1. A weaving loom blade crossbeam, comprising (a) two edge areas extending parallel to the longitudinal direction of the crossbeam; and (b) a median area arranged between said edge areas;

(c) one of said edge areas being strengthened in the longitudinal direction of the crossbeam by a material containing an array of fibers extending primarily in the longitudinal direction;

(d) the other edge area being formed of metal and carrying a heddle member;

(e) said median area being integrally formed with said other edge area and being at least partially formed of metal and having one of a planar and frame configuration.

2. A crossbeam as defined in claim 1, wherein when said median area comprises a metal plate, said median area comprises at least one layer of a relatively light and noise-attenuating material laterally fit as a reinforcement to one phase of said plate, and when the median area comprises a metal frame containing openings, at least said openings are sealed by a noise-attenuating material.

3. A crossbeam as defined in claim 2, wherein said noise-attenuating material is formed by a continuous layer made of a material strengthened by fibers and is glued at least to the outer face of said frame.

4. A crossbeam as defined in claim 1, wherein when the median area comprises a material strengthened by fibers, said area comprises a honeycomb core, the two longitudinal faces of which are covered with a layer of material strengthened by fibers integrally formed with the core.

5. A crossbeam as defined in claim 1, wherein when the median area comprises a material strengthened by fibers, said area comprises a tri-dimensional fabric in which empty spaces are filled with a reinforcing, noise-attenuating foam material.

6. A crossbeam as defined in claim 1, wherein when said median area comprises a material strengthened by fibers, a connecting element having a cross-section in the shape of a fork is provided between said other edge area and said edge adjacent to said median area, thereby allowing for fitting these two areas together.

7. A crossbeam as defined in claim 6, wherein a clearance is provided between the bottom of the space defined by the fork and the edge of one of said two areas to compensate for sagging of the median area during fitting.

8. A crossbeam as defined in claim 7, wherein said connecting element is part of the metal edge area that carries the heddle member with the edge adjacent the median area glued into the fork of said element.

9. A crossbeam as defined in claim 1, wherein said edge area strengthened in the longitudinal direction of the crossbeam by a material that contains fibers and situated opposite to the median area comprises a generally U-shaped profile obtained through protrusion of carbon fibers impregnated with a resin, the wings of which extend on both sides of the longitudinal edge adjacent to the median area.

10. A weaving loom blade crossbeam, comprising two edge areas extending in the longitudinal direction of the crossbeam, said edge area being separated by a median area, with one of said edge areas being strengthened in the longitudinal direction of the crossbeam by a material that contains an array of fibers extending in the longitudinal direction and with the other edge area being formed of metal and carrying a heddle member, wherein said median area comprises a part separate from said other edge area and fitted to the latter by one of gluing and molding, said median area comprising a material strengthened by fibers in such a manner that stresses in the median area can be absorbed, said median area forming an angle of 45° with the longitudinal direction of the crossbeam.

11. A crossbeam as defined in claim 10, wherein at least one slit is provided in said other edge area, said slit extending at least partly opposite the heddle member.

* * * * *